United States Patent [19]

Yashiki

[11] Patent Number: 4,579,801

[45] Date of Patent: Apr. 1, 1986

[54] ELECTROPHOTOGRAPHIC PHOTOSENSITIVE MEMBER HAVING PHENOLIC SUBBING LAYER

[75] Inventor: Yuichi Yashiki, Yokohama, Japan

[73] Assignee: Canon Kabushiki Kaisha, Tokyo, Japan

[21] Appl. No.: 634,059

[22] Filed: Jul. 25, 1984

[30] Foreign Application Priority Data

Aug. 2, 1983 [JP] Japan ..... 58-140562
Nov. 18, 1983 [JP] Japan ..... 58-218298

[51] Int. Cl.[4] ..... G03G 5/14

[52] U.S. Cl. ..... 430/60; 430/64; 430/65

[58] Field of Search ..... 430/65, 64, 63, 62, 430/60; 428/532

[56] References Cited

U.S. PATENT DOCUMENTS 4,317,856 3/1982 Huthwelker et al. ..... 428/532
4,416,963 11/1983 Takimoto et al. ..... 430/63

FOREIGN PATENT DOCUMENTS 6532 1/1977 Japan .

*Primary Examiner*—John L. Goodrow
*Attorney, Agent, or Firm*—Fitzpatrick, Cella, Harper & Scinto

[57] ABSTRACT

An electrophotographic photosensitive member characterized by having a phenolic resin layer formed from a resol coat, between a substrate and a photosensitive layer.

41 Claims, No Drawings

ELECTROPHOTOGRAPHIC PHOTOSENSITIVE MEMBER HAVING PHENOLIC SUBBING LAYER

BACKGROUND OF THE INVENTION

1. Field of the Invention

The present invention relates to an electrophotographic photosensitive member provided with an intermediate layer, for example, a subbing layer (bond layer) or an electrically conductive layer.

2. Description of the Prior Art

While an electrophotographic photosensitive member is made up basically of a substrate and a photosensitive layer, it is effective to insert a subbing layer between the substrate and the photosensitive layer so as to improve the adhesion thereof to each other and the coating workability of the photosensitive layer, protect the substrate, cover defects on the substrate, protect the photosensitive layer from electric breakdown, and facilitate the injection of electric charge from the substrate into the photosensitive layer.

It is known that the subbing layer has hitherto been formed of a polymer such as poly(vinyl alcohol), poly(-vinyl methyl ether), poly(N-vinylimidazole), ethyl cellulose, methyl cellulose, ethylene-acrylic acid copolymer, casein, gelatin, polyamide and the like.

Requirements for the subbing layer concern, in the first place, electric characteristics thereof. Since the subbing layer is used in an electrophotographic photosensitive member, it is important that the subbing layer has no adverse effect on the electrophotographic performance characteristics. Hence the subbing layer is required to have a low electric resistance. If the electric resistance is too high, a so-called residual potential remains in the subbing layer after charging the photosensitive layer and causes fog on the resulting image.

Moreover the electric resistance of the subbing layer is required not to be affected by the variation in environmental conditions, particularly by the variation in atmospheric humidity. For instance, fog will result if the electric resistance increases appreciably with decrease in the atmospheric humidity.

While such characteristics are required for the subbing layer, there have been difficulties up to now in satisfying these requirements with a single resin layer. Accordingly, a very thin resin layer or a resin layer in which a conductive powder (a powder of metal such as nickel, copper, silver and the like) has been dispersed is used as the subbing layer. However, such a thin resin layer functions insufficiently as a subbing layer while such a resin layer containing a dispersed metal powder is inferior in surface smoothness since the metal powder contains coarse particles.

On the other hand, the electrically conductive layer has hitherto been formed from an electrolyte such as lithium chloride, sodium chloride etc., dissolved in aqueous solution of a water-soluble resin such as poly(-vinyl alcohol) or methyl cellulose or from a polyelectrolyte such as a macromolecular quaternary ammonium salt or a macromolecular sulfonic acid salt dissolved in water. However, such electrically conductive layers are hardly acceptable for electrophotographic photosensitive members because the electric resistance of the layers much increases with decrease in environmental humidity. In order to cover defects on the substrate surface, the conductive layer needs to be thick and therefore the electric resistance thereof is required to be low.

Since a satisfactory conductive layer is hardly obtained from a single resin, a measure taken is to use a dispersion of electrically conductive powder in a resin. Electrically conductive powders used for this purpose include powders of metals such as nickel, copper, silver, aluminum etc., powders of metal oxides such as iron oxide, tin oxide, antimony oxide, indium oxide and the like, and carbon powders.

For binding these electroconductive powders, there are used thermoplastic resins including acrylic resin, vinyl acetate resin, vinyl chloride-vinyl acetate copolymer, linear polyester, phenoxy resin and the like. However, these resins generally have difficulties in use for the intermediate layer of electrophotographic photosensitive members because they are inferior in solvent resistance and hence attached with the solvent used in a coating liquid for forming the photosensitive layer. Accordingly, thermosetting resins are preferably used as binders for the electrically conductive layer. Such thermosetting resins include epoxy resin, urethane resin, unsaturated polyester, alkyd resin, acrylmelamine resin, silicone resin rubbers that can be hardened and the like.

The electrically conductive layer needs to meet requirements, besides for the above-mentioned electric properties, for physical properties such as strong adhesion to the substrate and to the overlying layer (e.g. the photosensitive layer) and surface smoothness and for other properties relating to production techniques such as the ability to disperse the conductive powder uniformly, coating workability under appropriate conditions, ease of the hardening, and storage stability (pot life) of the coating liquid. However, the above-mentioned thermosetting resins cannot sufficiently satisfy the above requirements for physical properties and for properties relating to production techniques, still having many remaining problems to be solved.

SUMMARY OF THE INVENTION

An object of the present invention is to provide an electrophotographic photosensitive member which overcomes the above noted drawbacks.

Another object of the invention is to provide an electrophotographic photosensitive member having an intermediate layer which can substantially cover defects on a coarse surface substrate.

Still another object of the invention is to provide an electrophotographic photosensitive member having an intermediate layer which has smooth surface and a sufficient thickness, between a coarse surface substrate and a photosensitive layer.

Further object of the invention is to provide an electrophotographic photosensitive member having an intermediate layer which is sufficiently improved to satisfy requirements for solvent resistence, for the above noted physical properties, and for properties relating to production techniques.

Still further object of the invention is to provide an electrophotographic photosensitive member having a conductive layer as an intermediate layer improved in the dispersion uniformity of the conductive material contained therein.

According to the present invention, there is to provide an electrophotographic photosensitive member having as an intermediate layer a phenolic resin layer formed from a resol coat, between a substrate and a photosensitive layer.

DETAILED DESCRIPTION OF THE PREFERRED EMBODIMENTS

The resol can be prepared by the reaction of a phenol and an aldehyde in the presence of an alkali catalyst. The aldehyde is used in excess over the phenol. The reaction of the resol to form a hardend phenolic resion proceeds on heating or addition of acid.

Suitable phenols for producing the resol are m-cresol, o-cresol, p-cresol, 3,5-xylenol, 2,5-xylenol 2,4-xylenol, and phenol. Suitable aldehydes are formaldehyde, furfural, and acetaldehyde. A specially favorable resol in the invention is the reaction product of phenol with formaldehyde.

Suitable alkali catalysts for producing the resol include; alkali metal hydroxides such as sodium hydroxide, lithium hydroxide, potassium hydroxide and the like; and primary, secondary, or tertiary amines such as dimethylamine, ethyleamine, methylamine, diethylamine, di-n-propylamine, isopropylamine, n-propylamine, hexamethylenetetramine, pyridine, dibenzylamine, trimethylamine, benzylamine, triethylamine and the like; and ammonia.

Commercially available resols of this type include Plyophen J-325 and Plyophen 5010 of Dainippon Ink And Chemicals, Inc. The phenolic resin produced by hardening such a type of resol under prescribed conditions is desired to have an average molecular weight of 350–20,000.

The intermediate layer in the electrophotographic photosensitive member of the invention is formed by applying an alcoholic solution of the resol on a substrate and heating the coat uniformly. Suitable alcohols in this case are methanol and ethanol. However, when the intermediate layer is used as an electrically conductive layer, an ethylene glycol ether and/or an ethylene glycol ester is preferred as the solvent to the above alcohols, in view of the dispersion uniformity of an electrically conductive material in the phenolic resin. It is also possible to use a mixture of the above ethylene glycol ether or ethylene glycol ester with the above alcohol, wherein the mixing ratio (by weight) of the alcohol to the ethylene glycol ether or ethylene glycol ester is desired to be about 1:1–4:1. Suitable ethylene glycol ethers for the solvent are 2-methoxyethyl alcohol, 2-ethoxyethyl alcohol, and ethylene glycol dimethyl ether, and suitable ethylene glycol esters are methyl Cellosolve acetate and ethyl Cellosolve acetate.

As stated above, an electrically conductive material can be dispersed in the intermediate layer of the present electrophotographic member. Suitable electrically conductive materials for this purpose include; powders of metals, e.g. nickel, copper, silver, aluminum and the like; powders of metal oxides, e.g. iron oxide, tin oxide, antimony oxide, indium oxide, titanium oxide, aluminum oxide and the like; and powders of carbon, barium carbonate, and barium sulfate. Particle sizes of the electrically conductive powder are desired to be in the range of 0.01 to 1$\mu$ and the content of the powder in the electrically conductive layer is desirably 10–90%, preferably 40–80%, by weight. The volume resistivity of this electrically conductive layer is adjusted with the electrically conductive powder content to a value of desirably up to $10^{13}$ $\Omega$cm, preferably up to $10^{12}$ $\Omega$cm.

In a preferred embodiment of the invention, a titanium oxide powder coated with tin oxide or with alumina can be used as an electrically conductive powder for the electrically conductive layer. This titanium oxide is preferably of rutile type.

A titanium oxide powder can be improved to exhibit better dispersibility than a tin oxide powder by the surface treatment with tin oxide or alumina. A method for the surface treatment of a titanium oxide powder with tin oxide comprises dispersing the titanium oxide powder in hot water and adding a solution of $SnCl_4$ in acetone to the dispersion to hydrolize $SnCl_4$ and deposit $SnO_2$ on a surface of the titanium oxide particles.

A titanium oxide powder can be improved in dispersibility and surface smoothness by surfacetreatment with alumina. A method for the surface treatment of a titanium oxide powder with alumina comprises dispersing the titanium oxide powder in an aqueous solution of aluminum salt, adding an alkali to the dispersion to deposit aluminum hydroxide on the titanium oxide particles, and heating the filtered powder at a high temperature.

The electrically conductive layer in the electrophotographic photosensitive member of the invention can be formed in the following way: One of the above-cited electrically conductive materials is mixed with a solution of resol in one of the above-cited ethylene glycol ethers and ethylene glycol esters by means of a roll mill, ball mill, vibrating ball mill, attritor, sand mill colloid mill or the like. The resulting coating liquid is applied on a substrate by a suitable coating method, e.g. dip coating, roll coating, Meyer bar coating, bead coating, or curtain flow coating method. The coat is hardened under prescribed conditions to form a phenolic resin layer in which the conductive material is dispersed uniformly. While the optimum hardening conditions depend upon the nature of the resol used, the resol-containing coat is heated generally at a temperature of 80°–200° C. for a period of 10 minutes–1 hour, preferably at a temperature of 100°–150° C. for a period of 20 minutes–1 hour, to be converted into a hardened insoluble phenolic resin layer. Thickness of the phenolic resin layer is in the range of generally 0.5–30$\mu$, preferably 5–20$\mu$.

When a photosensitive layer is formed directly on the electrically conductive layer, it happens sometimes that parts of the photosensitive layer are protruded into the conductive layer or buried therein or an interaction between the conductive material and the photosensitive layer causes some changes in the electrophotographic characteristics. Accordingly, another preferred embodiment of the invention is provided with a resin layer (bond layer) containing no electrically conductive powder, between the electrically conductive layer and the photosensitive layer. Suitable resins for the bond layer include water-soluble resin, e.g. poly(vinyl alcohol), poly(vinyl methyl ether), polyvinylpyridine, poly(acrylic acid), methyl cellulose, ethyl cellulose, poly(glutamic acid), casein, gelatin, starch and the like, and water-insoluble resins, e.g. polyamide, phenolic resin, poly(vinyl formal), polyurethane elastomer, alkyd resin, ethylene-vinyl acetate copolymer, vinylpyrrolidone-vinyl acetate copolymer and the like. According to the present inventors' experiments, polyamide is best suited among these resins. This polyamide means linear polyamide, typical examples of which are nylon and copolymer nylon. The polyamide is preferred to be amorphous or low crystalline since it is applied in the form of solution on the electrically conductive layer in the invention. Such polyamides can be prepared by copolymerization or by reacting formaldehyde and alcohol with amide groups of a usual nylon resin to produce a so-called 8-nylon. Thickness of the polyamide layer is in the range of 0.3 to 2μ.

In another preferred embodiment of the invention, an intermediate layer is formed from a coating material which comprises a resin and dispersed titanium oxide particles coated with both $Sb_2O_3$ and $SnO_2$. This treated titanium oxide powder is featured as follows: (1) The resistivity of the powder is about 2–500 Ωcm. (2) Since the raw material is titanium oxide, the average particle of the untreated powder is very as small as 0.1–0.5μ and that of the treated powder is also as small as 0.2–0.6μ, so that the dispersibility is excellent. (3) The resulting coat has good surface smoothness for the same reason. (4) The color of the resulting coat is pale gray, having little influence on the electrophotographic characteristics. Accordingly, this treated titanium oxide powder is effectively used in the invention. In this case, $Sb_2O_3$ with $SnO_2$ forms a solid solution, thereby serving to lower the resistivity of $SnO_2$.

Titanium oxide has crystal forms of rutile type and anatase type, either of which may be used in the invention, but the rutile type is preferred. Suitable proportions of the $SnO_2$–$Sb_2O_3$ coat are 5–67% by weight based on the total weight of the coated particles. The proportion less than 5% by weight gives no sufficient electrically conductivity, while the proportion exceeding 67% by weight results in low mechanical strength of the particles, coarse particles in the powder, and undesirably high costs.

This coat is composed of 1–20% by weight of $Sb_2O_3$ and the remainder $SnO_2$. The $Sb_2O_3$ content less than 1% by weight gives no sufficient electrically conductivity, while the content exceeding 20% by weight results in a dark blue coloration of the powder. The coating is accomplished by dispersing a titanium oxide powder in hot water and adding a tin chloride-antimony chloride solution in acetone to the dispersion to hydrolyze the chlorides and deposit $SnO_2$ and $Sb_2O_3$ on the surface of titanium oxide particles. Another method of the coating comprises spraying titanium oxide particles heated at high temperatures of about 300° C., with an aqueous tin chloride-antimony chloride solution to hydrolyze the chlorides and deposit $SnO_2$ and $Sb_2O_3$. Still another method of the coating comprises adding (1) a tin chloride-antimony chloride solution in an aqueous HCl of concentration enough to prevent the hydrolysis and (2) an aqueous ammonia at the same time to an aqueous suspension of titanium oxide heated at a temperature of 50°–100° C., hydrolyzing the chlorides by neutralization to deposit $SnO_2$ and $Sb_2O_3$ on the surface of titanium oxide particles.

A coating material is prepared by dispersing the thus treated titanium oxide powder in a binder resin solution. In this case, any resin may be used so far as it meets the following requirements: (1) It strongly adheres to the substrate, (2) the powder can be well dispersed therein, and (3) it has sufficient solvent resistance. Particularly suitable are thermosetting resins or elastomers such as rubbers that can be hardened, polyurethane resin, epoxy resin, alkyd resin, phenolic resin, unsaturated polyester resin, silicone resin, and acryl-melamine resin. Suitable volume resistivities of the resin coat in which the surface-treated titanium oxide is dispersed are up to $10^{13}$ Ωcm, particularly up to $10^{12}$ Ωcm. For attaining these resistivities, the content of the surface-treated titanium oxide in the resulting coat is desired to be at least 30% by volume or at least 60% by weight.

When the resistivity of the resulting coat is sufficiently low, additional use of another pigment is effective for reducing the cost of the coating material and for improving the whiteness thereof. For this purpose, a usual titanium oxide powder untreated is suitable. Moreover a titanium oxide powder surface-treated with alumina is effective for the purpose of improving the surface smoothness of the resulting coat. The method for this surface treatment comprises, for instance, dispersing a titanium oxide powder in an aqueous solution of aluminum salt, adding an aqueous solution of aluminum salt to the dispersion to deposit aluminum hydroxide on the titanium oxide particles, and subjecting the resulting powder to intense heat.

The above pigment (the coated titanium oxide powder with or without the untreated titanium oxide powder) is dispersed in a solution of the above-cited resin in the ordinary way to form a coating liquid, which is then applied on a substrate suitable for electrophotographic photosensitive members, dried, and if necessary, heated, thus forming an intermediate conductive layer. The thickness of this electrically conductive layer depends upon the degree of imperfection on the substrate surface and is desirably about the twice power of the maximum surface roughness of the substrate.

Hereupon the maximum surface roughness of the conductive layer must not exceed 2μ. If it exceeds 2μ, defects will appear occasionally on the resulting copies. This maximum surface roughness varies with the proportion of the powder to the resin, the thickness of this layer, and with some other factors, it is necessary to determine the optimum values of these factors in advance.

While the photosensitive layer is usually formed on the conductive layer, free carriers will be injected into the photosensitive layer from the electrically conductive layer at times depending upon components of the photosensitive layer. This phenomenon, if occurs, is followed by a greater potential decay on the photosensitive layer and by difficulties of image formation. In such cases, the injection of free carriers can be prevented by covering the conductive layer with a second thin resin layer which contains no electrically conductive powder. This second resin layer can be formed of a water-soluble resin, e.g. poly(vinyl alcohol), poly(vinylmethylether), poly(acrylic acid), methyl cellulose, ethyl cellulose, poly(glutamic acid), casein, gelatin, starch and the like or a water-insoluble resin, e.g. melamine resin, polyamide, epoxy resin, polyurethane, polyglutamate ester, and the like. Of these resins, polyamide is best suited in respects to coating workability, resistivity, and resistance to the solvent which will be used for the coating liquid to form the photosensitive layer. However, the adhesion of polyamide to the electrically conductive layer varies greatly with the binder resin used in the electrically conductive layer. The present inventors have revealed that the adhesion of polyamide is enhanced by using a resol type of phenolic resin as a binder resin for the conductive layer. This resol type of phenolic resin and suitable polyamide resins have been described already. The polyamide is dissolved in an alcohol such as methanol, ethanol, or butanol to form a coating liquid. An aromatic hydrocarbon, e.g. toluene or xylene, is added thereto if necessary for the purpose of stabilizing the coating liquid. This polyamide solution is applied on the conductive layer to a dry thickness of 0.1–2μ. Defects will be liable to appear on the coat if it is too thin, while residual potential will be observed if the coat is too thick.

The electrophotographic photosensitive member of the invention is described further referring to the substrate and the photosensitive layer.

The substrate is formed from; a metal, e.g. aluminum, aluminum alloy, copper, brass, stainless steel and the like; a polymer, e.g. poly(ethylene terephthalate), poly(-butylene terephthalate), phenolic resin, polypropylene, nylon resin, polystyrene and the like; or hard paper. The substrate is used in the form of cylinder, film, or foil. When the substrate is made of an insulator, a treatment thereof is necessary for providing electrically conductivity thereto. Methods of this treatment include the impregnation of the substrate with an electrically conductive material, lamination of a metal foil upon the substrate, vapor deposition of a metal on the substrate, and the method according to the invention which comprises overlaying the substrate in series with the above described intermediate electrically conductive layer, the polyamide layer if necessary, and the photosensitive layer.

The photosensitive layer is formed by coating method from a photoconductor, e.g. a zinc oxide powder sensitized with coloring matter, selenium powder, amorphous silicon powder, polyvinylcarbazole, phthalocyanine pigment, oxadiazole pigment and the like, and if necessary, a binder resin.

When an organic photoconductive material is used, a method for improving electrophotographic characteristics of the photosensitive layer is to divide the layer into a charge generation layer that generates charge carriers therein an image exposure and a charge transport layer that has the function of transporting charge carriers injected from the charge generation layer.

The charge generation layer is formed by applying a dispersion of charge-generating material selected from pigments or dyes such as azo pigments (e.g. Sudan Red, Dian Blue, Genus Green B and the like), quinone dyes (e.g. Algol Yellow, pyrenequinone, Indanthrene Brilliant Violet RRP and the like), quinocyanine pigments, perylene pigments, indigo pigments (e.g. indigo, thioindigo and the like), bis(benzoimidazole) pigments (e.g. Indo Fast Orange Toner), phthalocyanine pigments (e.g. copper phthalocyanine), quinacridone pigments, and pylylium dyes, in a solution of a binder resin selected from polyester, polystyrene, poly(vinyl acetate), acrylic resin, poly(vinylbutyral), polyvinylpyrrolidone, methyl cellulose, hydroxypropyl methyl cellulose, and cellulose ester. The charge generation layer can also be formed by vapor deposition. Thickness of this layer is of the order of 0.05–0.2$\mu$.

The charge transport layer is formed by coating method from a hole-transporting material comprising compounds having aromatic condensed ring hydrocarbons (e.g. anthracene, pyrene, phenanthrene, and coronene), and nitrogen-containing heterocyclic compounds (e.g. indole, carbazole, isooxazole, thiazole, imidazole, pyrazole, oxadiazole, pyrazoline, thiadiazole, triazole, and substitution products of these compounds) in a main or side chain and hydrazone compounds, said hole-transporting material being dissolved in a solution of a resin which can be formed into a film. The resin is used since the above charge-transporting materials are deficient in the film forming property due to its lower molecular weight. Examples of such resins are polycarbonate, polyarylate, polystyrene, polymethacrylate esters, styrene-methyl methacrylate copolymer, polyester, styrene-acrylonitrile copolymer, polysulfone and the like. Thickness of the charge transport layer is of the order of 5–20$\mu$.

In the production of the electrophotographic photosensitive member of the present invention, the cost of substrate fabrication can be reduced to a great extent because the substrate surface is allowed to be coarse. In addition, the photosensitive member having a resin layer in which a powder is dispersed is useful for laser beam printers and other applications wherein lasers are used as light sources since the surface of the resin layer containing a dispersed powder scatters light and hence the reflection and interference of laser rays are substantially prevented.

The following examples illustrate the invention. In the Examples the "parts" are all by weight.

EXAMPLES 1–2 and COMPARATIVE EXAMPLES 1–5

50 parts of a tin oxide powder and 50 part of a rutile type titanium oxide powder were mixed with each of the following resin solutions a–g. In the formulations, the amounts of resins indicate the parts by weight of non-volatile matter.

| | | |
|---|---|---|
| a. | Resol (supplied by Dainippon Ink And Chemicals, Inc. under the trademark of Plyophen J-325) | 40 parts |
| | Methanol | 30 parts |
| | 2-Methoxyethyl alcohol | 30 parts |
| b. | Resol (the same as the above) | 40 parts |
| | Methanol | 55 parts |
| c. | Urethane resin (supplied by Mitsui-Toatsu Chemicals, Inc. under the trademark of Olester Q-173) and hardener (supplied by the same company under the tradename of Olester P-49-75S) | 40 parts |
| | Ethyl acetate | 25 parts |
| | Toluene | 25 parts |
| d. | Epoxy resin (supplied by Shell Chemical Co. under the tradename of Epicoat 1001) and hardener (triethylene-tetramine) | 40 parts |
| | Toluene | 50 parts |
| e. | Acrylic resin (supplied by Dainippon Ink And Chemicals, Inc. under the tradename of Acrydick A 190) | 40 parts |
| | n-Butanol | 10 parts |
| | Toluene | 45 parts |
| f. | Alkyd resin (supplied by Dainippon Ink And Chemicals, Inc. under the tradename of Beckosol 1308) and hardener (lead octanoate) | 40 parts |
| | Toluene | 50 parts |
| g. | Unsaturated polyester resin (supplied by Mitsubishi Gas Chemicals Co., Ltd. under the tradename of Espol 3226) and hardener (benzoyl peroxide) | 40 parts |
| | Toluene | 50 parts |

Each mixture was ball-milled for 5 hours to be made up into a coating liquid, which was then applied around an aluminum cylinder of 60 mm in outer diameter and 260 mm in length so as to give a dry thickness of 20$\mu$. After drying, coats were hardened under the conditions shown in Table 1.

TABLE 1

| Example No. | Resin solution | Agglomerates | Pot life | Hardening conditions | Adhesion to cylinder | Solvent resistance |
|---|---|---|---|---|---|---|
| Example 1 | a | None | ca. 6 months | 140° C., 30 min. | Good | High |
| Example 2 | b | Appeared after ca. 12 hrs. | ca. 6 months | 140° C., 30 min. | Good | High |
| Comparative Example 1 | c | None | 3 days | 150° C., 2 hours | Good | Medium |
| Comparative Example 2 | d | None | 12 hours | 120° C., 30 min. | Good | High |
| Comparative Example 3 | e | None | ≧1 year | 120° C., 10 min. | Good | Low |
| Comparative Example 4 | f | None | 2 weeks | 150° C., 1 hour | Good | Low |
| Comparative Example 5 | g | None | 2 months | 150° C., 10 min. | Poor | Medium |

EXAMPLE 3

A solution of 4 parts of a copolymer nylon resin (supplied by Toray Industries Inc. under the tradename of Amilan CM 8000) and 4 parts of a 8-nylon resin (supplied by Teikoku Kagaku Co., Ltd. under the tradename of Toresin EF 30T) in a mixture of 60 parts of methanol and 30 parts of butanol was applied on the conductive layer (a phenolic resin layer in which tin oxide and titanium oxide were dispersed) by the dip coating method, and dried to form a polyamide resin layer 0.5μ thick.

Then, 10 parts of a disazo pigment represented by the formula:

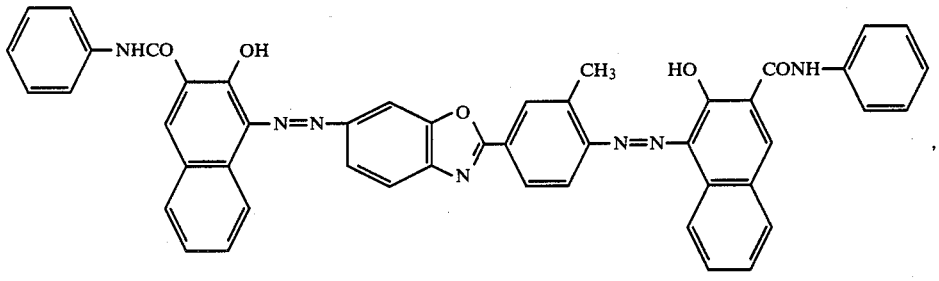

6 parts of a cellulose acetate-butyrate resin (supplied by Eastman Chemical Products, Inc. under the tradename of CAB-381), and 60 parts of cyclohexanone were sand-milled for 20 hours using 1-mmϕ glass beads. The resulting dispersion, after addition of 100 parts of methyl ethyl ketone, was applied on the above subbing layer (polyamide resin layer) by dipping and dried at 100° C. for 10 minutes to form a charge generation layer of 0.1 g/m$^2$ in coating weight.

Then, 10 parts of a hydrazone compound represented by the formula:

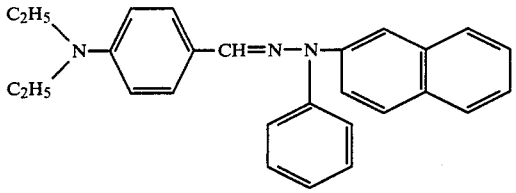

and 12 parts of a styrene-methyl methacrylate copolymer (supplied by Seitetsu Kagaku Co., Ltd. under the tradename of MS-200) were dissolved in 70 parts of toluene and applied on the charge generation layer. The coat was dried at 100° C. for 60 minutes, forming a charge transport layer 16μ thick.

The thus prepared electrophotographic photosensitive member gave copies of good image quality.

The above procedure was repeated on the electrically conductive layers of Comparative Examples 1–5. The results showed that; the photosensitive members of Comparative Examples 1 and 2, although the electrically conductive layers were good in characteristics as an electrically conductive layer, involved problems in productivity because of the short pot lives; the electrically conductive layers of Comparative Examples 3 and 4 were inferior in solvent resistance, that is, these layers were attacked during the application of the coating liquids to form the polyamide layers; and the electrically conductive layer of Comparative Example 5 was poor in adhesion to the substrate and liable therefore to peel off, causing objections to normal image formation.

EXAMPLE 4

An electrically conductive powder was prepared by the surface coating of a rutile type titanium oxide powder with tin oxide and antimony oxide ($Sb_2O_3$: 10 wt % of $SnO_2$) (the coating weight was 75% of the weight of $TiO_2$).

A mixture of 10 parts of this conductive powder. 5 parts of a resol (supplied by Dainippon Ink And Chemicals, Inc. under the tradename of Plyophen 5010), 8 parts of ethanol, and 6 parts of 2-ethoxylethyl alcohol was ball-milled for 6 hours. The resulting dispersion was applied around an aluminum cylinder of 60 mm in diameter×260 mm in length and hardened at 150° C. for 30 minutes to form an electrically conductive layer 20μ thick.

This electrically conductive layer was good in adhesion onto the cylinder and in solvent resistance. The coating liquid for this layer showed a pot life of 6 months or more and no agglomeration during a considerable period of time.

This conductive layer was overlaid in series with a polyamide resin layer, charge generation layer, and charge transport layer by repeating the procedure of Example 3. The thus obtained photosensitive member gave similar good results.

EXAMPLE 5

An aluminum cylinder of 60 mm in diameter×260 mm in length was used as substrate. The maximum surface roughness was found to be 11μ. A mixture of 40 parts of a rutile type titanium oxide powder surface-treated with tin oxide (the proportion of $SnO_2$ was 43 wt %), 20 parts of a resol (Plyophen 5010), 20 parts of methyl Cellosolve acetate, and 100 parts of ethanol was ball-milled for 6 hours. The resulting dispersion was applied by dipping on the substrate and hardened by heating at 150° C. for 30 minutes to form an intermediate conductive layer 25μ thick.

The electrically conductive layer was good in adhesion to the cylinder and in solvent resistance.

The electrically conductive layer was overlaid in series with a polyamide resin layer, charge generation layer, and charge transport layer by repeating the procedure of Example 3, thus completing an electrophotographic photosensitive member.

The photosensitive member was set in an electrophotographic copying machine which was provided with the stages of −5.6 KV corona charging, image exposure, dry development of toner image, toner image transfer to plain paper, and cleaning with an urethane rubber blade (Shore hardness 70°, contact pressure 10 g/cm, angle with the photosensitive surface 20°), to evaluate electrophotographic characteristics thereof. The original charged potential was −620 V and good images were obtained.

EXAMPLE 6

An aluminum cylinder of 60 mm in diameter×260 mm in length was used as substrate. The maximum surface roughness was found to be 11μ. A mixture of 40 parts of a tin oxide powder, 60 parts of a rutile type titanium oxide powder surface-treated with alumina (the proportion of alumina: 12 wt %), 100 parts of a resol (Plyophen J-325), 50 parts of ethyl Cellosolve acetate, and 80 parts of ethanol was ball-milled for 6 hours to prepare a dispersion. This dispersion was applied by dipping on the substrate and hardened by heating at 140° C. for 30 minutes to form an intermediate electrically conductive layer 25μ thick.

The electrically conductive layer was overlaid in series with a polyamide resin layer, charge generation layer, and charge transport layer by repeating the procedure of Example 3, thus completing an electrophotographic photosensitive member.

This photosensitive member was set in the copying machine used in Example 5 to form copies, giving good quality images.

EXAMPLE 7

An aluminum pipe of 60 mm in outer diameter and 55 mm in inner diameter was cut into cylinders each 300 mm long. One of the cylinders was used as substrate.

A mixture of 25 parts of carbon black (average particle size 0.05μ), 120 parts of an acrylic resin (supplied by Dainippon Ink And Chemicals, Inc. under the tradename of Acrydic A405, solid content: 50 wt%), 25 parts of a melamine resin (supplied by Dainippon Ink And Chemicals, Inc. under the tradename of Super Beckamine L121, solid content: 60 wt%), and 80 parts of toluene was roll-milled to prepare a dispersion. This dispersion was applied by dipping on the substrate to form a subbing layer 20μ thick and was hardened by heating at 150° C. for 30 minutes.

Then a solution of 40 parts of a resol (Plyophen J-325) in a mixture of 30 parts of methanol and 30 parts of 2-methoxyethyl alcohol was applied on the subbing layer and hardened by heating at 140° C. for 30 minutes to form an intermediate phenolic resin layer 1μ thick.

This layer was overlaid in series with a polyamide layer, charge generation layer, and charge transport layer by repeating the procedure of Example 3, thus completing an electrophotographic photosensitive member. This photosensitive was set in the copying machine used in Example 5 to form copies, giving good quality images.

EXAMPLE 8

An aluminum cylinder of 60 mm in diameter×260 mm in length was used as substrate. The maximum surface roughness was found to be 5μ.

50 parts of a titanium oxide powder (supplied by Titan Kogyo Co., Ltd. under the tradename of ECT 62) coated with 75 wt%, based on the original powder, of a 10:90 (by weight) $Sb_2O_3$-$SnO_2$ mixture and 50 parts of a titanium oxide powder (supplied by Sakai Kagakukogyo Co., Ltd. under the tradename of SR-1) coated with 2 wt %, based on the original powder, of alumina were mixed with a solution of a resol (Plyophen 5010, solid content: 58 wt%) in 60 parts of methyl ethyl ketone. The mixture was ball-milled for 6 hours to prepared a coating dispersion.

This coating dispersion, adjusted to a viscosity of 90 cp, was applied by dipping on the substrate, air-dried for 10 minutes, and hardened by heating at 150° C. for 20 minutes to form an intermediate conductive layer 18μ thick. The maximum surface roughness thereof was found to be 0.75μ.

Then a solution of 10 parts of a copolymer nylon (Amilan CM 8000) in a mixture of 60 parts of methanol and 40 parts of butanol was applied by dipping on the intermediate electroconductive layer and dried to form a polyamide resin layer 1μ thick.

A mixture of 10 parts of a disazo pigment represented by the formula:

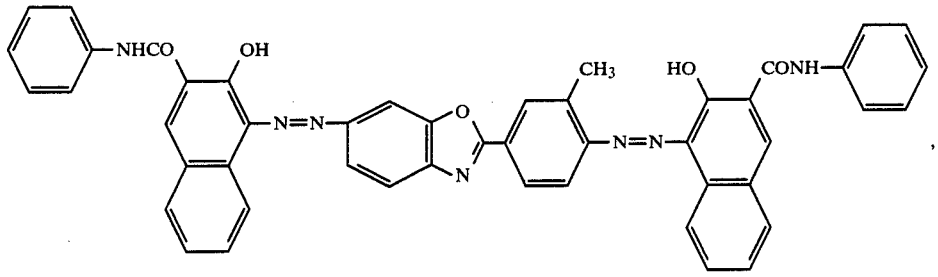

6 parts of a cellulose acetate-butyrate resin (CAB-381), and 60 parts of cyclohexanone was sand-milled for 20 minutes using glass beads of 1 mm in diameter. The resulting dispersion, after addition of 100 parts of methyl ethyl ketone, was applied by dipping on the polyamide resin layer, and dried by heating at 100° C. for 10 minutes to form a charge generation layer of 0.1 g/m$^2$ in coating weight.

Then, a solution of 10 parts of a hydrazone compound represented by the formula

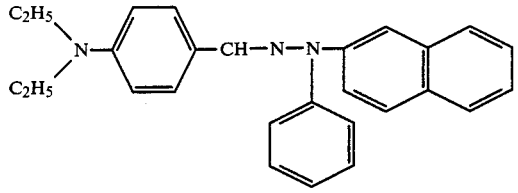

and 15 parts of a styrene-methyl methacrylate copolymer resin (MS-200 supplied by Seitetsu Kagaku) in 80 parts of toluene was applied on the charge generation layer and dried in hot air at 100° C. for 1 hour to form a charge transport layer 16μ thick.

The thus prepared electrophotographic photosensitive is designated as sample (1).

For comparison, the following photosensitive members were prepared.

Sample (2): The same photosensitive layers were formed directly on the same substrate without forming such an intermediate electrically conductive layer or polyamide resin layer.

Sample (3): The same intermediate electrically conductive layer was formed on the same substrate and the same photosensitive layers were formed directly on the intermediate electrically conductive layer.

Sample (4): The sample polyamide layer was formed directly on the same substrate without forming such an intermeditae electrically conductive layer and the same photosensitive layers were formed on the polyamide resin layer.

These photosensitive members were each set in the electrophotographic copying machine use in Example 5 and electrophotographic characteristics of the member were evaluated. The results were as shown in Table 2.

TABLE 2

| Photosensitive member | Sample (1) | Sample (2) | Sample (3) | Sample (4) |
|---|---|---|---|---|
| $V_D$ (dark portion potential) | −620 V | −650 V | −200 V | −610 V |
| $V_L$ (light portion potential) | −180 V | −240 V | −100 V | −190 V |
| Image quality | Good | Rough | Image density was very low | Rough |
| Remarks | | Photosensitive layers readily peeled off | | |

As shown in Table 2, sample (1) was the best photosensitive member. As to sample (4), the image quality is affected by the coarse surface of the substrate, which must be polished to a maximum roughness of 0.5μ or less in order to obtain fine image quality. In contrast to this, sample (1) can be produced without requiring such a surface finish and hence at a lower cost.

EXAMPLE 9

50 parts of a titanium oxide powder (supplied by Mitsubishi Metal Co., Ltd. under the tradename of W-10) coated with 70 wt %, based on the original powder, of a mixture of $SnO_2$ and $Sb_2O_3$ ($Sb_2O_3$ content 9 wt%) and 45 parts of a titanium oxide powder (SR-IT) coated with 2 wt%, based on the original powder, of alumina were mixed with a solution of 40 parts of a resol (supplied by Dainippon Ink And Chemicals, Inc. under the tradename of Plyophen 5030) in 60 parts of methyl ethyl ketone. The mixture was ball-milled for 6 hours to prepare a coating dispersion.

Using this coating dispersion, an electrophotographic photosensitive member was prepared in the same manner as in Example 8. This photosensitive member also gave good quality images. The maximum surface roughness of the coated layer was 0.8μ.

EXAMPLE 10

95 parts of a titanium oxide powder (W-10) coated with 70 wt%, based on the original powder, of a mixture of $SnO_2$ and $Sb_2O_3$ ($Sb_2O_3$ content 9 wt%) and a solution of 40 parts of a resol (Plyophen 5030) in 60 parts of methyl ethyl ketone were ball-milled for 6 hours. Using the resulting dispersion, an electrophotographic photosensitive member was prepared in the same manner as in Example 8. This photosensitive member also gave good quality images. The maximum surface roughness of the coated layer was 0.9μ.

EXAMPLE 11

An electrophotographic photosensitive member was prepared by repeating the procedure of Example 9 but using an untreated titanium oxide powder in place of the alumina-treated titanium oxide powder. The maximum surface roughness of the coated layer was 0.9μ. This photosensitive member also gave good quality images.

What is claimed is:

1. An electrophotographic photosensitive member characterized by having a phenolic resin layer formed from a resol coat, between a substrate and a photosensitive layer.

2. The electrophotographic photosensitive member of claim 1, wherein the phenolic resin layer formed from a resol coat contains a dispersed electrically conductive material.

3. The electrophotographic photosensitive member of claim 2, wherein the electrically conductive material is a powder of at least one selected from the group consisting of nickel, copper, silver, aluminum, carbon, barium carbonate, barium sulfate, iron oxide, titanium oxide, tin oxide, antimony oxide, aluminum oxide, and indium oxide.

4. The electrophotographic photosensitive member of claim 2, wherein the electrically conductive material is a titanium oxide powder having an aluminum oxide coat around the particle.

5. The electrophotographic photosensitive member of claim 2, wherein the conductive material is a titanium oxide powder having a tin oxide coat around the particle.

6. The electrophotographic photosensitive member of claim 3, wherein the titanium oxide is of rutile type.

7. The electrophotographic photosensitive member of claim 1, wherein the resol is the product of the reaction of a phenol selected from the group consisting of m-cresol, o-cresol, p-cresol, 3,5-xylenol, 2,5-xylenol, 2,4-xylenol, and phenol with an aldehyde selected from the group consisting of formaldehyde, furfural, and acetaldehyde, in the presence of an alkali catalyst.

8. The electrophotographic photosensitive member of claim 7, wherein the aldehyde is formaldehyde.

9. An electrophotographic photosensitive member characterized by having a phenolic resin layer formed from a resol coat and a polyamide resin layer between a substrate and a photosensitive layer.

10. The electrophotographic photosensitive member of claim 9, wherein the phenolic resin layer formed from a resol coat contains a dispersed electrically conductive material.

11. The electrophotographic photosensitive member of claim 10, wherein the electrically conductive material is a powder of at least one selected from the group consisting of nickel, copper, silver, aluminum, carbon, barium carbonate, barium sulfate, iron oxide, tin oxide, antimony oxide, aluminum oxide, and indium oxide.

12. The electrophotographic photosensitive member of claim 10, wherein the electrically conductive material is a titanium oxide powder having an aluminum oxide coat around the particle.

13. The electrophotographic photosensitive member of claim 10, wherein the electrically conductive material is a titanium oxide powder having a tin oxide coat around the particle.

14. The electrophotographic photosensitive member of claim 12, wherein the titanium oxide is of rutile type.

15. The electrophotographic photosensitive member of claim 9, wherein the resol is the product of the reaction of a phenol selected from the group consisting of m-cresol, o-cresol, p-cresol, 3,5-xylenol, 2,5-xylenol, 2,4-xylenol, and phenol with an aldehyde selected from the group consisting of formaldehyde, furfural, and acetaldehyde, in the presence of an alkali catalyst.

16. The electrophotographic photosensitive member of claim 15, wherein the aldehyde is formaldehyde.

17. The electrophotographic photosensitive member of claim 9, wherein the polyamide resin layer comprises a copolymerized polyamide.

18. An electrophotographic photosensitive member prepared in a process comprising the steps of coating a substrate with a solution of resol in an ethylene glycol ether and/or an ethylene glycol ester, hardening the resol to form a phenolic resin layer, and overlaying the phenolic resin layer with a photosensitive layer or with a polyamide resin layer and a photosensitive layer.

19. The electrophotographic photosensitive member of claim 18, wherein the solution of resol in an ethylene glycol ether and/or an ethylene glycol ester contains a dispersed electrically conductive material.

20. The electrophotographic photosensitive member of claim 19, wherein the electrically conductive material is at least one metal oxide selected from the group consisting of titanium oxide, tin oxide, and aluminum oxide.

21. The electrophotographic photosensitive member of claim 19, wherein the electrically conductive material is a titanium oxide powder having an aluminum oxide coat around the particle.

22. The electrophotographic photosensitive member of claim 19, wherein the conductive material is a titanium oxide powder having a tin oxide coat around the particle.

23. The electrophotographic photosensitive member of claim 20, wherein the titanium oxide is of rutile type.

24. The electrophotographic photosensitive member of claim 18, wherein the resol is produced by reacting a phenol selected from the group consisting of m-cresol, o-cresol, p-cresol, 3,5-xylenol, 2,5-xylenol, 2,4-xylenol, and phenol with an aldehyde selected from the group consisting of formaldehyde, furfural, and acetaldehyde, in the presence of an alkali catalyst.

25. The electrophotographic photosensitive member of claim 24, wherein the aldehyde is formaldehyde.

26. The electrophotographic photosensitive member of claim 18, wherein the polyamide resin layer comprises a copolymerized polyamide.

27. The electrophotographic photosensitive member of claim 18, wherein the ethylene glycol ether is 2-methoxyethyl alcohol, 2-ethoxyethyl alcohol, or ethylene glycol dimethyl ether.

28. The electrophotographic photosensitive member of claim 18, wherein the ethylene glycol ester is methyl Cellosolve acetate or ethyl Cellosolve acetate.

29. An electrophotographic photosensitive member characterized by having on an electrically conductive substrate a resin layer in which a titanium oxide power coated with a mixture of antimony oxide and tin oxide is dispersed as the main component and a photosensitive layer overlying the resin layer.

30. The electrophotographic photosensitive member of claim 29, wherein the resin is a phenolic resin.

31. The electrophotographic photosensitive member of claim 30, wherein the phenolic resin is formed by hardening resol.

32. The electrophotographic photosensitive member of claim 29, wherein the content of antimony oxide in the coating mixture around the titanium oxide particles is in the range of 1 to 20% by weight.

33. The electrophotographic photosensitive member of claim 29, wherein the volume resistivity of the resin layer is up to $10^{13}$ Ωcm.

34. The electrophotographic photosensitive member of claim 29, wherein the volume resistivity of the resin layer is up to $10^{12}$ Ωcm.

35. The electrophotographic photosensitive member of claim 29, wherein the resin layer contains at least 30% by volume of a titanium oxide powder coated with a mixture of antimony oxide and tin oxide.

36. The electrophotographic photosensitive member of claim 29, wherein the resin layer contains at least 60% by weight of a titanium oxide powder coated with a mixture of antimony oxide and tin oxide.

37. An electrophotographic photosensitive member characterized by having (1) a phenolic resin layer formed by hardening a resol coat which contains mainly a titanium oxide powder coated with a mixture of antimony oxide and tin oxide and (2) a polyamide resin layer, between a substrate and a photosensitive layer.

38. The electrophotographic photosensitive member of claim 37, wherein the polyamide resin is a copolymerized polyamide.

39. The electrophotographic photosensitive member of claim 37, wherein the phenolic resin layer is in contact with the substrate.

40. The electrophotographic photosensitive member of claim 37, wherein the photosensitive layer is a laminate consisting of a charge generation layer and a charge transport layer.

41. The electrophotographic photosensitive member of claim 40, wherein the substrate is overlaid in series with a phenolic resin layer, polyamide resin layer, charge generation layer, and charge transport layer.

* * * * *

UNITED STATES PATENT AND TRADEMARK OFFICE

CERTIFICATE OF CORRECTION

PATENT NO. : 4,579,801

DATED : APRIL 1, 1986

INVENTOR(S) : YUICHI YASHIKI

It is certified that error appears in the above-identified patent and that said Letters Patent is hereby corrected as shown below:

COLUMN 3

Line 7, "hardend phenolic resion" should read --hardened phenolic resin--.
Line 19, "ethyleamine," should read --ethylamine,--.

COLUMN 4

Line 26, "sand mill colloid mill" should read --sand mill, colloid mill--.
Line 61, "inventors'" should read --inventor's--.

COLUMN 5

Line 11, Delete "very".
Line 27, "electrically" should read --electrical--.
Line 33, "electrically" should read --electrical--.

COLUMN 6

Line 57, "inventors" should read --inventor--.

COLUMN 7

Line 13, "electrically" should read --electrical--.

UNITED STATES PATENT AND TRADEMARK OFFICE

CERTIFICATE OF CORRECTION

PATENT NO. : 4,579,801

DATED : APRIL 1, 1986

INVENTOR(S) :

YUICHI YASHIKI

It is certified that error appears in the above-identified patent and that said Letters Patent is hereby corrected as shown below:

COLUMN 8

Line 33, "trademark" should read --tradename--.
Line 39, "trademark" should read --tradename--.

COLUMN 11

Line 8, "powder. 5" should read --powder, 5--.

COLUMN 16

Line 56, "power" should read --powder--.

Signed and Sealed this

Twenty-fourth Day of March, 1987

*Attest:*

DONALD J. QUIGG

*Attesting Officer*

*Commissioner of Patents and Trademarks*